United States Patent [19]

Griffin et al.

[11] 3,967,370

[45] July 6, 1976

[54] METHOD OF MANUFACTURING A MULTICONTACT SWITCH

[75] Inventors: Harry Charles Griffin, Mountain View; Thomas Edwin Holden, Scotts Valley; Orland Edgar Upton, Campbell, all of Calif.

[73] Assignee: Hewlett-Packard Company, Palo Alto, Calif.

[22] Filed: Apr. 3, 1975

[21] Appl. No.: 564,948

[52] U.S. Cl. ..... 29/622; 29/625; 200/5 R; 200/159 A

[51] Int. Cl.[2] ..... H01H 11/00

[58] Field of Search ..... 200/5 R, 5 A, 159 B, 200/159 A, 275, 292; 29/622, 624, 625, 626, 628, 630 R, 429, 430, 33 Q; 228/4.1, 5.1, 6, 13, 15.1, 17; 113/119, 116 Y, 116 BB; 72/324

[56] References Cited

UNITED STATES PATENTS

| | | | |
|---|---|---|---|
| 3,378,626 | 4/1968 | Tucker | 113/119 X |
| 3,768,293 | 10/1973 | Ruesch | 29/33 Q X |
| 3,819,882 | 6/1974 | Anderson et al. | 200/159 A X |

*Primary Examiner*—C.W. Lanham
*Assistant Examiner*—James R. Duzan
*Attorney, Agent, or Firm*—Patrick J. Barrett

[57] ABSTRACT

A multicontact switch for use in a keyboard is manufactured from a plurality of metallic strips and a printed circuit board. The strips are passed through rollers that form arched portions in the strips, and the arched portions are then aligned with contact areas on the printed circuit board. After this alignment the strips are spot welded to the printed circuit board while they are held in place by clamps. After one board has been welded to the strips it is moved from the welding station and another group of arched portions in the strips is aligned with another board. Following this alignment the strips are sheared between the two boards, thereby producing a completed multicontact switch structure.

23 Claims, 10 Drawing Figures

METHOD OF MANUFACTURING A MULTICONTACT SWITCH

BACKGROUND OF THE INVENTION

Multicontact switch structures are used in numerous applications today. One of the most frequent applications for such structures is in keyboards for calculators, computers, and other electronic devices. Many applications, such as hand-held calculators, require light weight, compact, reliable switch structures that can be economically produced. One class of switch structure used in hand-held calculators has a plurality of arched strips which are fastened to some of the conductors on a printed circuit board. Switching action is produced by defelecting the arched portions into contact with other conductors on the printed circuit board with keys located above the arched portions. This type of switch is described in a U.S. patent application Ser. No. 173,754 filed Aug. 23, 1971, now U.S. Pat. No. 3,941,953, by Willliam W. Misson, et al., entitled "Keyboard Having Switches with Tactile Feedback" and in the *Hewlett-Packard Journal*, June 1972, page 12.

Typically the arched strips used in prior art switch structures have been made in the following manner. A number of strips of metal are cut to have a length approximately equal to the width of the printed circuit board. Then a number of parallel, oblong slots are etched in the strip to define the portions of the strip that are to be arched. Next this etched strip is placed in a press to deform portions of the strip to form the arches. After this deformation process, the strips are hardened to produce the proper spring quality, since the material has to be soft to allow the stretching that occurs when it is deformed to form the arches. If the hardened material were to be deformed in the press, the material would simply break. After hardening, the strip is plated and then is soldered or welded to the printed circuit board. This method of manufacture has the disadvantage that it requires the handling of several individual strips for each printed circuit board, thus increasing handling and assembly costs. Furthermore, etching the oblong holes in the strip material is an expensive process making the strips undesirably expensive as compared to the other components in a keyboard.

SUMMARY OF THE INVENTION

According to the preferred embodiment of the present invention, a single piece of material, such as age hardened beryllium-copper, is plated and slit into a plurality of strips. These strips then pass through a punch which forms a parallel series of index holes in the strips and through forming rollers which form a series of arches in each strip. A conveyor belt carries printed circuit boards with switch contact areas, and the formed strips are aligned with the contact area as the strips and printed circuit boards are brought together. Each printed circuit board with its associated portion of the formed strips is brought to a welding station, and the arches in the strips are registered with the appropriate contact areas by engaging the indexing holes with a row of locating pins. The formed strips are clamped in place, and a first row of welds is made to attach each strip to the printed circuit board at one point. Next the portions of the strips connecting the board being welded to the previously welded board are sheared and the remainder of the welds is made, with the clamp being removed to facilitate making the last row of welds. When the welding operation is complete, the conveyor belt is moved to bring a new printed circuit board into position for welding to another portion of each of the strips.

This process eliminates a number of the costs and problems in the prior art manufacturing process. It is not necessary to harden the strips after forming, according to the process of the present invention, because the material may be deformed into the arches without breaking it, since no stretching of the material is required. In addition, materials handling is simplifed with this process since reels containing long strips of material can be used. The strips used on each printed circuit board are cut after the welding process, thus eliminating the handling and alignment of a number of short strips for each board. Finally, greater uniformity in the action of each switch element is achieved because all of the arches on a given printed circuit board are approximately the same thickness, with the same plating, since they are from the same portion of the original piece of material. In prior art keyboards, the thickness of the various arched portions might vary because of variations in the stamping process and because each strip on a printed circuit board might be from a different piece of material.

DESCRIPTION OF THE PREFEREED EMBODIMENT

Figure 1:
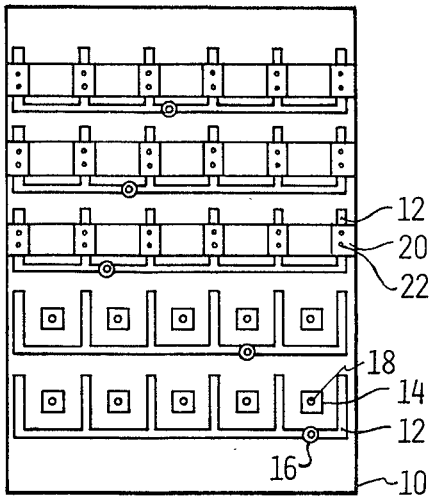
FIG. 1 shows a printed circuit board with arched strips attached thereto.

FIG. 1 shows a partially assembled multicontact switch of the kind produced by the method described herein. A substrate 10 has support contacts 12 and center contacts 14 on one of its surfaces. Contacts 12 and 14 are preferably printed circuit board traces or elements, i.e., layers of copper that have been laminated to the substrate and etched in a particular pattern. The contacts may also connect to various conductors on the other side of substrate 10 by plated through holes, for example, such as hole 16 in a trace connecting together various support contacts 12 or hole 18 in center contact 14. The contact areas may be plated with various conductive, non-corrosive or corrosion resistant materials such as gold.

A conductive, resilient strip 20 made of beryllium-copper, for example, is shown attached to some of the supporting contacts 12 by spot welds 22. The strips that would be attached to the first two rows of contacts have been omitted for illustrative purposes. The strips are arched over the center contacts and make connection with the contacts when deflected. As discussed more fully in the aforementioned patent application Ser. No. 173,754, the arched strip will snap when it is deflected and give a tactile feedback signal to the user, indicating contact has been made. Supporting structures and keys that may be used with the switch structure to make a keyboard will not be further discussed or illustrated here as the structure and operation or a keyboard using such a switch structure is well described and illustrated in the above references. The following discussion is directed to a novel method of manufacturing such a switch structure.

Figure 2:
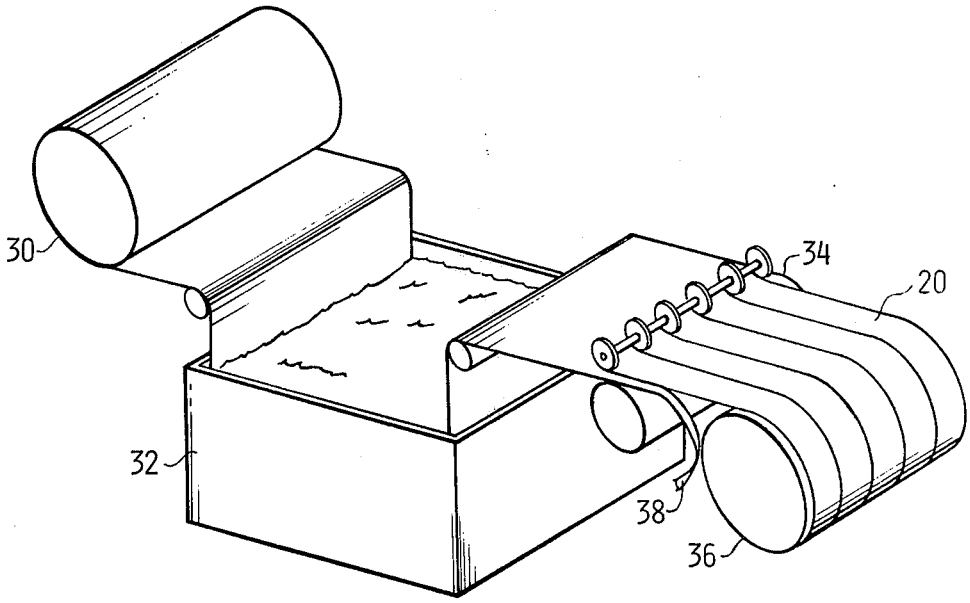
FIG. 2 shows a schematic diagram of a plating and slitting operation.

FIG. 2 shows a schematic illustration of the preparation of material for strips 20. A roll of material 30 is plated in a plating bath 32 with a material such as gold or alboloy which is highly electrically conductive but corrosion resistant. Alboloy is a commonly used designation for an alloy comprising 55–60% copper, 25–28% tin, and 14–18% zinc. The material from roll 30 is preferably 0.002 inch (0.05mm) thick beryllium-copper that has been aged hardened to a hardness designated as CA172 by the Copper Development Association, although other springy, conductive, formable materials may be used. After passing through the plating bath, the material is slitted into as many strips as there are rows of contacts on the substrate. In the illustrated switch structure, there are five rows of contacts and, therefore, five coils of strip material are shown in FIG. 2.

In the preferred embodiment, the material is slitted into strips that are 0.220 inches (5.6mm) wide, although it will be understood that other width strips could be used for other sizes of switching structures. As illustrated schematically in FIG. 2, there may be certain amount of material from roll 30 that is waste. The rolls 36 having the slit material or strips wound on them are kept together so that the strips in each switch structure are from the same portion of roll 30 thus having similar thickness and plating, and thereby exhibiting similar mechanical characteristics.

Figure 3:
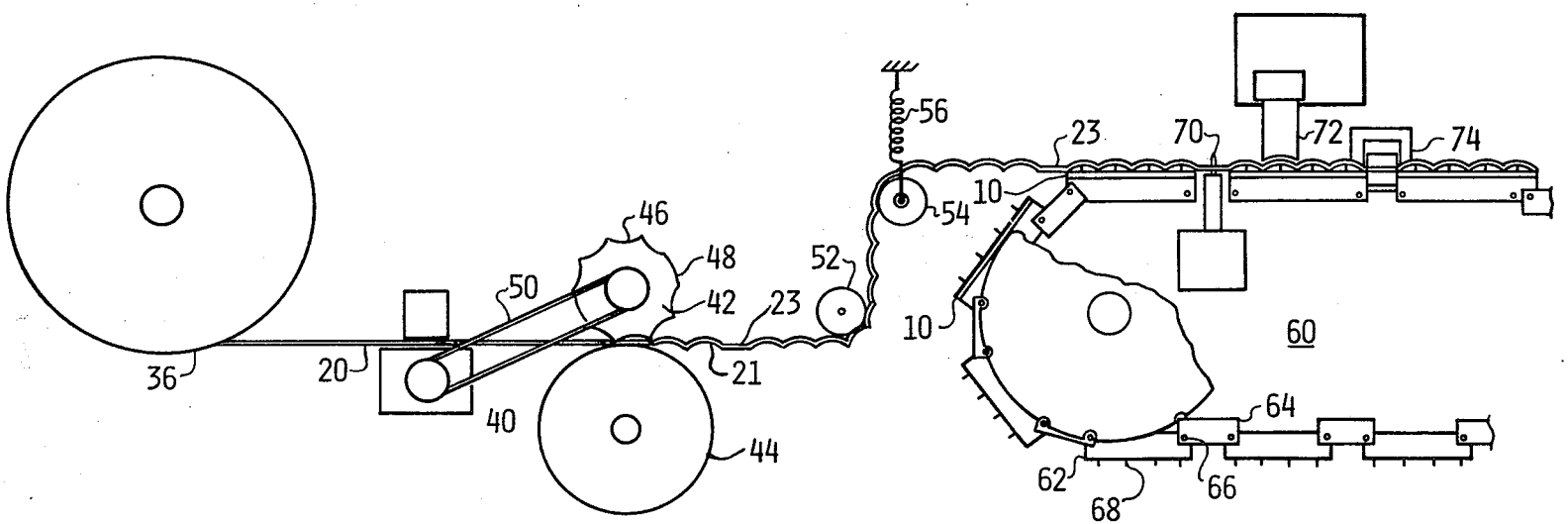
FIG. 3 shows a schematic diagram of a machine to punch, form, align, and attach metal strips to a printed circuit board.

FIG. 3 shows a schematic diagram of an apparatus for forming arches in strips 20 and attaching them to substrate 10. Strips 20 are wound off of roll 36 and passed through punch 40 which punches a hole in each strip at periodic intervals. The hole is used later in the manufacturing process as an index hole to locate each of the strips with respect to the substrate. Other indexing means could, of course, be used, such as a notch or a dimple.

The strips then pass between two forming rollers 42 and 44. Roller 42 has indentations 46 in its circumference and roller 44 is a resilient material such as polyurethane. Alternatively, roller 44 could also be a hard metal roller with protrusions which engage indentations 46. As the strips pass between the rollers, they are deformed into arched portions 21 by the indentations 46. The strip is left flat where the index hole occurs and thus some portions of roller 42, such as portion 48, are not indented so that flat portions 23 will be left in strip 20. In order to align the flat portions of the strip with the index holes, roller 42 is shown schematically connected to punch 40 by a belt 50.

After the forming operation, the strips pass over a roller 52 and a tensioning roller 54 shown schematically as suspended from a spring 56. The spring and tensioning roller take up any changes in length caused by temporarily varying rates of movement of strips through the forming rollers and through the apparatus that attaches the strips to the substrates.

Substrates 10 are carried on a conveyor belt 60 which comprises pallets 62 connected to links 64 and hinged at pins 66. Some of the links have been omitted to allow other portions of the apparatus to be shown more clearly. Each pallet also has a plurality of spring loaded pins 68 whose function will be more fully described below. The conveyor belt brings each substrate 10 up under the strips 20 between two of the flat areas 23.

The conveyor belt moves intermittently; and, when it is stopped, a set of indexing pins 70 are brought up through the holes in each strip 20 to align them with the contact areas on substrate 10. The strips are then welded by a spot welder 72, and the flat portions 23 between a substrate being welded and one that has already been welded are cut by a shear 74. The operation of the welder and the shear are described more fully below.

Figure 4:
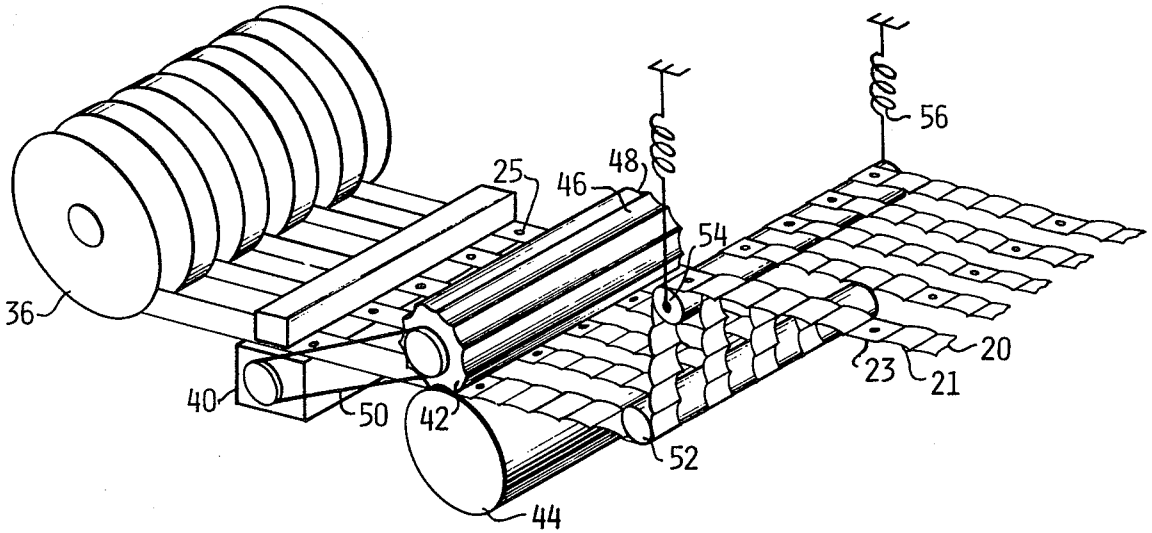
FIG. 4 shows a schematic diagram of a portion of the apparatus shown in FIG. 3 in greater detail.

FIG. 4 shows a perspective illustration of the apparatus for performing punching and forming operation described above. Each roll 36 of strip material is separated by approximately by the same distance as the strips will be separated on substrate 10, so that the strips run through the forming and attaching apparatus in a parallel fashion. Punch 40 forms a hole 25 in each strip 20 at the same time so that the rows of holes are parallel. As the strips pass between forming rolls 42 and 44, the non-indented portion 48 on roll 42 passes over those portions of each strip that have the indexing holes. Although FIG. 4 shows the same number of arches being formed in each strip 20, it should be understood that differing numbers of arches could be formed into each strip in accordance with the requirements of the switching mechanism. Such different arch spacing would merely require different spacings of the indentations 46 in the various portions of roller 42, or the insertion of non-indented portions between some of the indentations.

Figure 5:
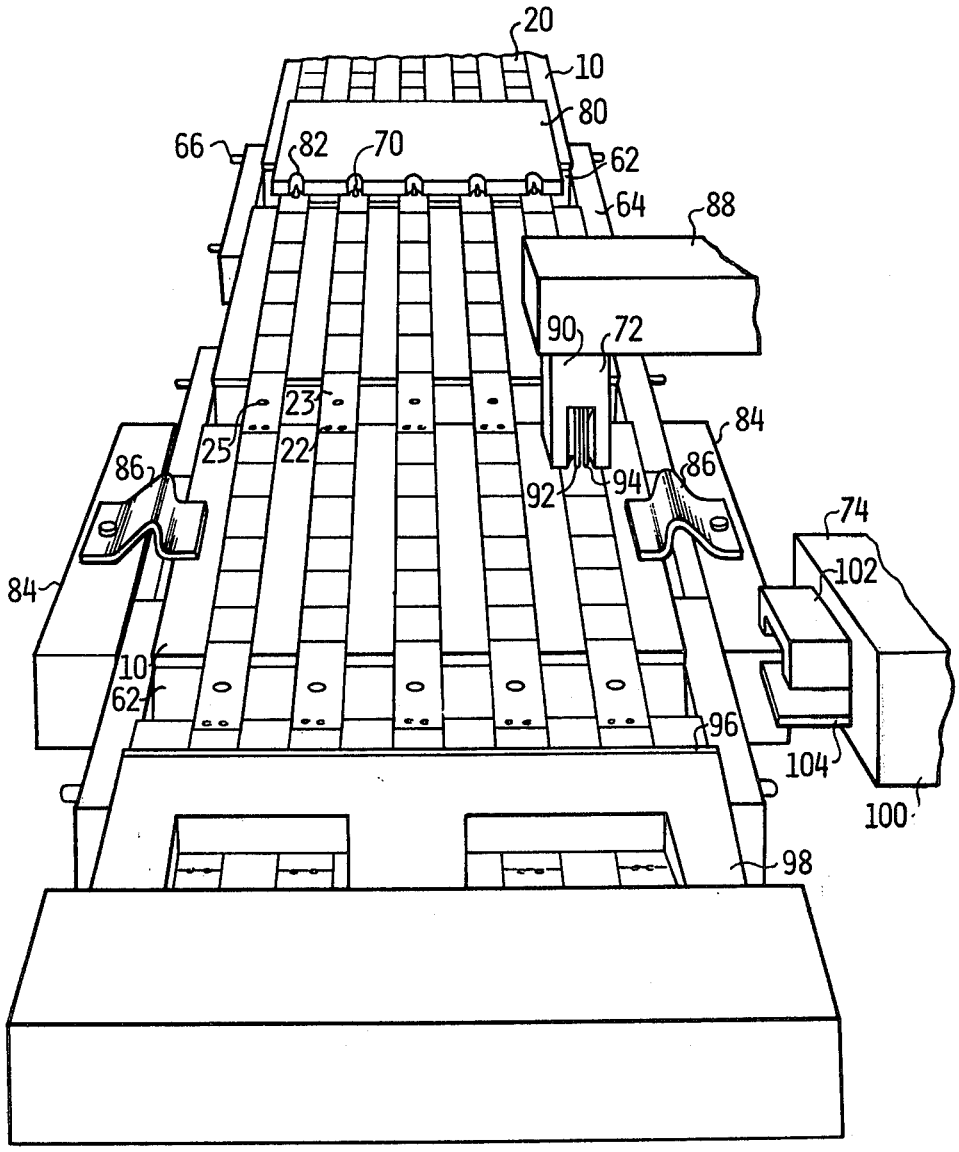
FIG. 5 shows another portion of the apparatus shown in FIG. 3 in greater detail.

FIG. 5 shows a perspective view of the apparatus that performs the aligning, welding, and cutting operations. The strips coming from roller 54 and a substrate 10 on a pallet 62 come together under a guide 80 which holds the strips against the substrate. On the front edge of guide 80 is a series of notches 82 which roughly align with holes 25 when the conveyor belt has stopped for the welding operation. At the time the conveyor belt stops, the pins 70 come up through holes 25 and into notches 82 to hold the strips in place and to align them on two axes with the contact areas on substrate 10.

When a pallet 62 with a substrate 10 and strips 20 is brought into position for welding, the pallet is locked into place by clamps 84 which engage one of the pins 66 on either side of the pallet. In addition, each clamp 84 has a spring clip 86 which keeps the substrate 10 down flat on the pallet. This is necessary because the spring loaded pins 68 push up on the bottoms of the welded strips and would push the substrate off the pallet if the spring clips were not there.

After the pallet is clamped into place, spot welder 72, which has an arm 88 carrying a foot 90 with two welding tips 92 and 94, is brought over the substrate to weld each of the strips to contact areas on the substrate. First a row of welds at the back edge of substrate 10 is put in to attach each of the strips to the substrate at one point. Following that, a notched guide 96 suspended on an arm 98 clamps each of the strips at the front edge of substrate 10 so that the strips can be severed from those on the previously welded substrate. Notched guide 96 is shown in the retracted position in FIG. 5 and the extended position in FIG. 6. After the notched guide 96 has been extended, the guides in shear 74 are extended from a housing 100. The shear guides comprise a top guide 102 and a bottom guide 104. Bottom guide 104 extends under flat portions 23 of each of the strips and between adjacent pallets while the top guide 102 extends over the top of the flat portions. Top guide 102 and bottom guide 104 are then secured in a latch 106 which holds top guide 102 tightly against the two adjacent substrates to prevent lateral movement of the strips during the shearing operation.

Figure 6:
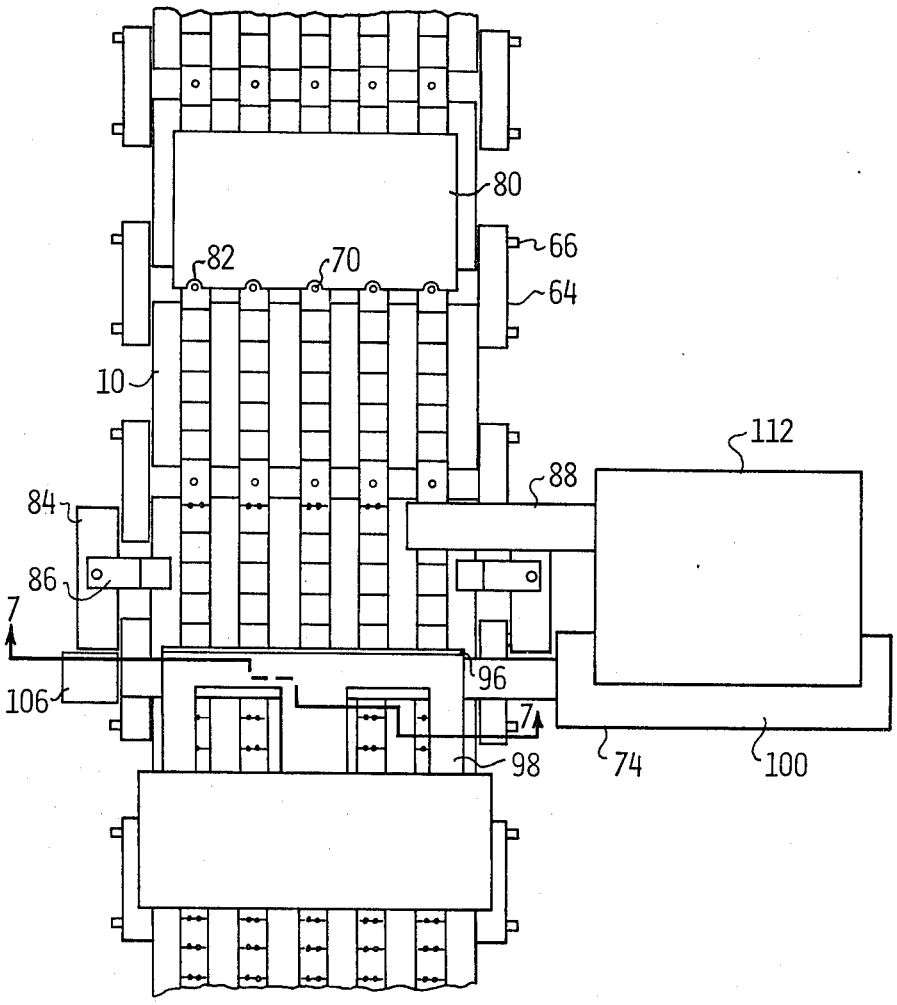
FIG. 6 shows a top view of the portion of the apparatus shown in FIG. 5.
Figure 7:
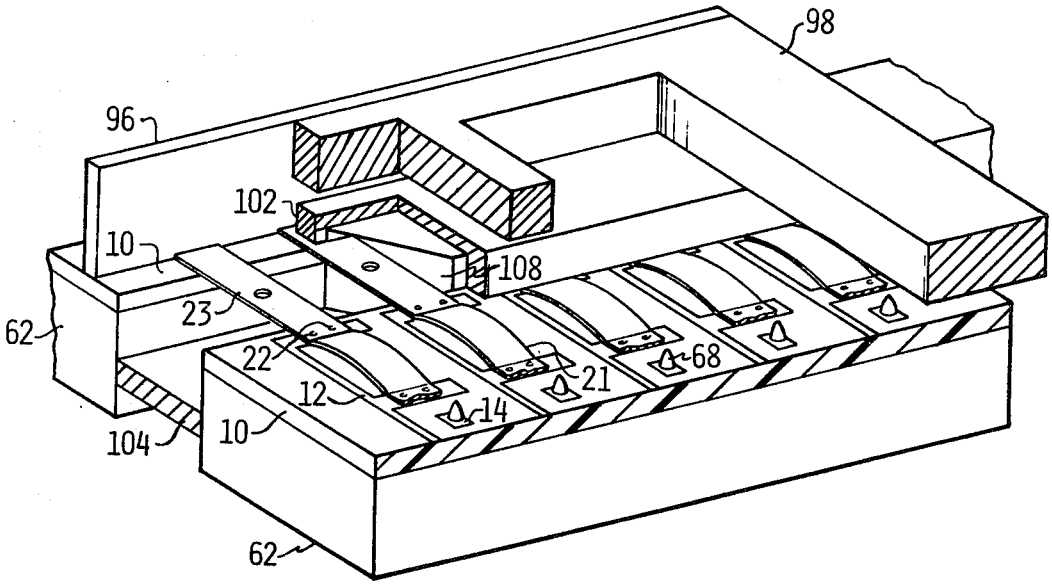
FIG. 7 shows a cutaway view of the clamping and shearing portion of the apparatus shown in FIG. 6.

FIG. 7 shows a partial cut away view of FIG. 6 illustrating the clamping and shearing operation. A shear blade 108 travels between bottom guide 104 and top guide 102 to shear flat portions 23 between two adjacent substrates 10. After the shear blade has sheared all of the flat portions, it is retracted again and latch 106 releases top guide 102 and bottom guide 104 so that they can also be retracted.

The welding operation then continues by spot welding each strip 22 to a support contact 12 between two of the arched portions 21. Before the last two of welds is made, notched guide 96 can be retracted out of the way to make more room for the welder foot. Since each strip is now welded in several places, the holding function of the notched guide is no longer needed to keep the strips in position.

Figure 8:
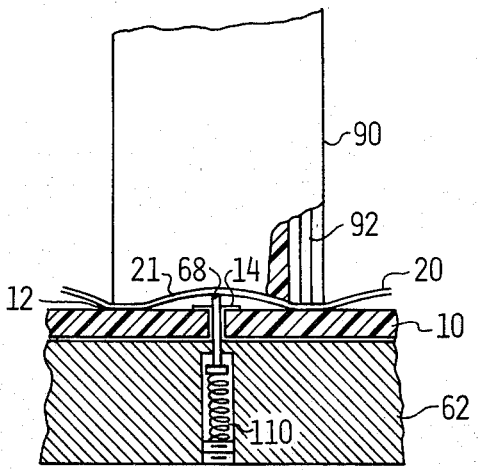
FIG. 8 shows a section of the apparatus shown in FIG. 5 during the welding operation.

FIG. 8 shows a section of a substrate 10 and pallet 62 along with a portion of welding welder foot 90 to illustrate the welding operation. The bottom portion of welder foot 90 has an indentation that corresponds with the curvature of an arched portion 21 of the strips. The arched portion is pushed up into the indentation of the foot by pin 68 which is loaded with a spring 110. The welding tips 92 and 94 then pass a current through the portion of the strip between two arches, welding that portion of the strip to a support contact 12.

Although a welding operation has been described in detail above, it should be understood that other attaching methods could be used. For example, solder preforms could be placed between each support contact 12 and a portion of strip 20 between two arched portions or selected portions of support contacts 12 could be precoated with solder. Then a heated soldering tip could be used in foot 90, instead welding tips 92 and 94, to melt the solder and thereby join the strip and the support contacts.

After the welding operations is completed, welding arm 88 is retracted into housing 112 and the conveyor is advanced one position to bring another pallet into the welding position. The substrate having the strips that were severed during the foregoing operation can then be removed from its pallet, ready for assembly into a keyboard structure.

Figure 9:
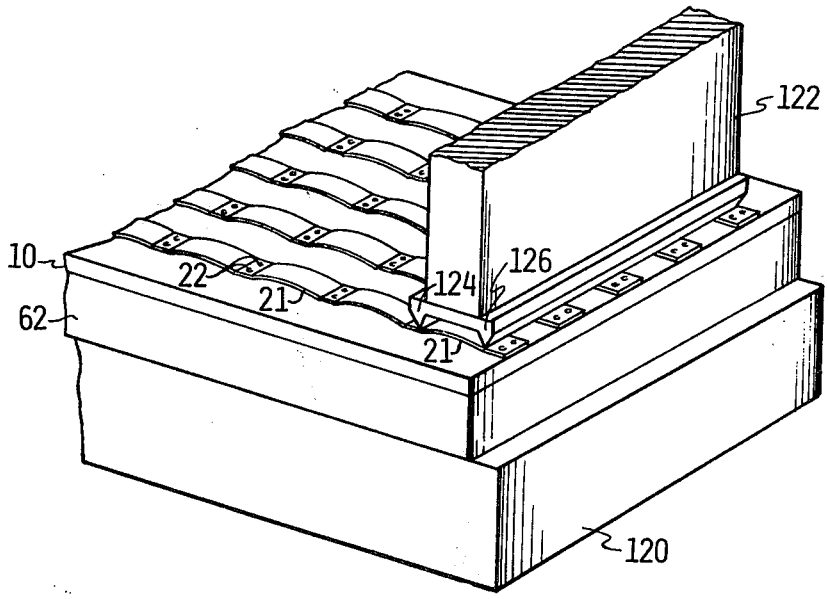
FIG. 9 shows apparatus for performing a crimping operation.

FIG. 9 illustrates an optional final processing step performed after the strips have been welded to a substrate. After a pallet 62 moves from the position where the strip portions between adjacent substrates are severed, it is brought over a press bed 120 which provides a firm support in the vertical direction. A plunger 122 attached to an arbor press (not shown), for example, has crimping blades 124 and 126 spaced apart approximately the same distance as an arched portion 21. The plunger is brought down over each row of arched portions to crease or crimp the bend in strip 20 between each of the arched portions or between each arched portion and an adjacent straight portion. It is believed that this crimping operation gives a more uniform tactile and audible response from the switches in a switch structure by making the bends at the end of each arched portion more uniform. After each row has been crimped, the substrate can be removed from the pallet for assembly into a keyboard structure.

Figure 10:
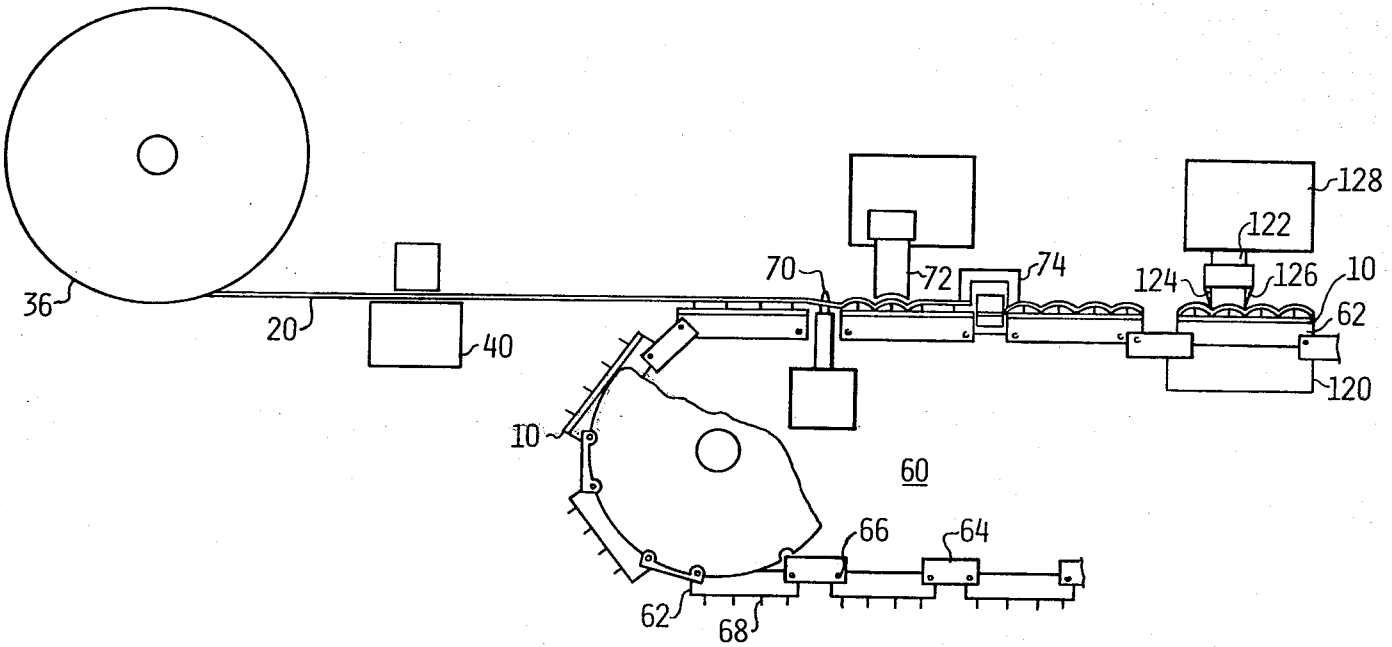
FIG. 10 shows a schematic diagram of a machine for performing another embodiment of the present invention.

FIG. 10 shows a schematic diagram of an alternate series of processing steps for forming the switch structure of FIG. 1. As described above, strips 20 from rolls 36 are passed through a punch 40 for forming a series of indexing holes in strips 20. The strips are then aligned with a substrate 10, as described above, and are brought into position for welding. Each strip is held above the substrate by spring loaded pins 68 until the welder 72 is brought over the strip. The arched indentation in the welder foot in cooperation with a spring loaded pin forms an arched portion in each strip as a portion of each strip between two spring loaded pins is welded to contacts 12 on the substrate. After each of the strips has been welded, the portion of each strip between two substrates is sheared in the manner described above. Following the shearing operation, bends are crimped in each strip at the ends of the arched portions by crimping blades 124 and 126 attached to plunger 122 on a press 128. After each arched portion has been crimped, the substrate can be removed from pallet 62 for assembly into a keyboard structure.

It will be understood by those skilled in the art that the operations described above can be partially or completely automated by using numerically programmed controllers to control the apparatus used in each of the described operations in the manner well known in the art. Alternatively, some or all of the operations can be manually performed by a machine operator.

We claim:

1. A method of making a multicontact switch comprising the steps of:

providing an insulative substrate having a plurality of first and second contact areas thereon;

providing a strip of conductive material;

forming a series of arched portions in the strip of material by passing the strip between a first and a second roller, the first roller having a series of indentations about its circumference and the second roller pressing the strip into the indentations in the first roller to form the arched portions;

aligning each of a predetermined number or arched portions on a selected length of the strip with selected ones of the first and second contact areas on the substrate;

fastening the selected length of strip to the substrate by attaching portions of the strip between each arched portion in the selected length of strip to the second contact areas so that each of the predetermined number of arched portions is arched over a first contact area; and severing the selected length of strip from the remainder of the strip.

2. A method as in claim 1 comprising the additional steps of:

forming indices in the strip at selected intervals; and using one of the indices to register each selected length of strip with respect to the substrate.

3. A method as in claim 1 wherein the step of fastening the selected length of strip to the substrate includes the steps of welding each of the portions between each arched portion in a selected length of strip to a second contact area and supporting each arched portion during the time a portion between that arched portion and an adjacent arched portion is being welded.

4. A method of making a multicontact switch comprising the steps of:

providing a plurality of strips of conductive material;

forming a series of arched portions in each of the strips;

providing an insulative substrate having a plurality of rows of first and second contact areas thereon;

aligning each of the strips with a row of first and second contact areas on the substrate;

registering each of a predetermined number of arched portions in a selected length of a strip with the first and second contact areas in a corresponding row;

fastening each selected length of each strip to the substrate by attaching portions between each arched portion in a selected length of a strip to the second contact areas in a corresponding row, so that each of the predetermined number of arched portions in each selected length of each strip is arched over a first contact area; and severing each selected length of each strip from the remainder of that strip.

5. A method as in claim 4 wherein the step of providing a plurality of strips comprises the steps of providing a source strip of conductive material and slitting the source strip into said plurality of strips.

6. A method as in claim 5 wherein the step of providing a source strip further comprises the step of plating the source strip with an electrically conductive, corrosion resistant material.

7. A method as in claim 4 wherein the conductive strip comprises a springy, metallic material and the step of forming the series of arched portions in each of the strips comprises passing the strips between a first and second roller, the first roller having a series of indentations about its circumference and the second roller pressing the strips into the indentations in the first roller to form the arched portions.

8. A method as in claim 7 comprising the additional step of forming indices in each of the strips at selected intervals and wherein the step of registering arched portions with first and second contact areas includes engaging one of the indices in each of the strips.

9. A method as in claim 7 wherein the step of fastening each selected length of each strip to the substrate includes spot welding each of the portions between each arched portion in a selected length of strip to a second contact area.

10. A method as in claim 9 wherein the step of fastening each selected length of each strip to the substrate comprises spot welding a first portion at one end of each selected length of strip to a second contact area, clamping the selected lengths of strips in position on the substrate, and welding the remaining portions between each arched portion in each selected length to remaining second contact areas.

11. A method as in claim 10 wherein the step of severing each selected length of strip follows the step of clamping the selected lengths of strips and precedes the step of welding the remaining portions between each arched portion in each selected length.

12. A method as in claim 11 wherein the step of fastening each selected length of each strip to the substrate includes removing the clamp before the last of the portions in each selected length of strip is welded to a second contact area.

13. A method as in claim 9 wherein the step of fastening each selected length of each strip to the substrate includes supporting each arch during the time a portion between that arch and an adjacent arch is being welded to a second contact area.

14. A method as in claim 13 comprising the additional step of crimping the ends of each arched portion after the step of fastening each selected length of each strip.

15. A method as in claim 7 wherein each of the selected lengths of strip is substantially the same as one of the dimensions of the substrate and the step of severing each selected length of strip comprises clamping each of the strips at an edge of the substrate and passing a shear along that edge of the substrate to shear off each of the strips.

16. A method as in claim 12 including the additional step of forming registration holes in each of the strips at selected intervals and wherein:

the step of registering arched portions with first and second contact areas includes engaging one of the registration holes in each of the strips;

the step of fastening each selected length of each strip to the substrate includes supporting each arch during the time a portion between that arch and an adjacent arch is being welded contact area; and each of the selected lengths of strip is substantially the same as a dimension of the substrate and the step of severing each selected length of strip includes passing a shear along an edge of the substrate after the step of clamping the selected length strips.

17. A method as in claim 16 wherein the step of providing a plurality of strips comprises the steps of:

providing a source strip of material;

plating the source strip with an electrically conductive, corrosion resistant material; and slitting the plated source strip into said plurality of strips.

18. A method of making a multicontact switch comprising the steps of:

providing an insulative substrate having first and second contact areas thereon;

providing a strip of conductive material;

aligning the selected length of strip with the first and second contact areas;

forming an arched portion extending transversely across the entire width of the strip in a selected length of the strip;

fastening the selected length of strip to the substrate by attaching portions of the strip adjacent the arched portion to the second contact areas so that the arched portion is arched over the first contact area; and severing the selected length of strip from the remainder of the strip.

19. A method as in claim 18 wherein the step of fastening the selected length of strip to the substrate includes the step of holding the arched portion of the strip in a fixture having an arched recess.

20. A method as in claim 19 wherein the step of severing the selected length is performed after the step of fastening the selected length of strip to the substrate.

21. A method as in claim 19 wherein the step of forming an arched portion in the strip comprises passing the strip between a first and a second roller, the first roller having a series of indentations about its circumference and the second roller being resilient, so that the strip is pressed into the indentations in the first roller by the second roller to form the arched portion.

22. A method as in claim 19 further including the step of creasing the ends of the arched portion.

23. A method as in claim 22 wherein the step of creasing the ends of the arched portion comprises crimping the ends of the arched portion in a press after the step of fastening the selected length of strip to the substrate.

* * * * *